United States Patent [19]

Kiener

[11] 4,030,526

[45] June 21, 1977

[54] MULTIPLE LOOM

[75] Inventor: Christian Kiener, Eloyes, France

[73] Assignee: Tex International, S.A., Luxembourg, Luxembourg

[22] Filed: Mar. 29, 1976

[21] Appl. No.: 671,065

[30] Foreign Application Priority Data

Apr. 11, 1975 Luxembourg ..... 72272

[52] U.S. Cl. ..... 139/18; 139/445; 139/20

[51] Int. Cl.[2] ..... D03D 33/00

[58] Field of Search ..... 139/11, 13, 16, 18, 139/20, 21, 22, 35, 97, 100, 443, 444, 445, 449

[56] References Cited

UNITED STATES PATENTS

| | | | |
|---|---|---|---|
| 2,682,894 | 7/1954 | Kiener | 139/18 |
| 3,735,783 | 5/1973 | Fritz et al. | 139/449 |

*Primary Examiner*—Henry S. Jaudon
*Attorney, Agent, or Firm*—Bacon & Thomas

[57] ABSTRACT

There is described a multiple loom having at least two looms arranged side-by-side and at the most four looms arranged side-by-side and back-to-back, with weft introduction by a single flexible lance, in which each loom is self-working, each loom has a lance guide approximately in the shape of a quarter circle extended vertically and there are provided lance control mechanisms which are arranged on either side of a plane common to said guides.

5 Claims, 15 Drawing Figures

MULTIPLE LOOM

This invention relates to a multiple loom comprising at least two looms arranged side-by-side and at the most four looms arranged side-by-side and back-to-back, with weft introduction by a single flexible lance.

There should first be reminded that the weaving operation is essentially comprised of laying a so-called weft thread between two so-called warp sheets; it is usual to compute the output from a loom according to the footage of weft laid per minute. The quotient of this weft output by loom surface area unit on the ground defines an area output which characterizes the theoretical rentability of a single or multiple loom.

The high level of such output allows indeed on the one hand to lower the high costs of heating, airconditioning and building depreciation, and on the other hand to increase the number of looms monitored by one weaver (due to shortening of his travels).

By analyzing the width taken by a loom (with or without shuttle), it is noticed that the width of the weft-laying members multiplies by a factor higher than 2 (2,6for rigid-lance looms), the nominal fabric width, which contributes to a low area output.

The present state of the art enables high area outputs essentially by the use of so-called large looms, the fabric width of which is two to three times the width of a narrow loom, that is from 2.5 to 3.5 meters.

Now it is known that the working of a loom is monitored by two safety stopping devices, namely the warp-protector and the weft-protector.

The warp-protector stops the loom as soon as a single thread breaks; it is thus clear that the wide loom incurs a proportional stoppage risk, that is for an usual fabric comprising 3000 warp threads per meter of width, the wide loom incurs a threefold stoppage risk, that is over 9000 threads.

This breakage probability corresponds to a thread with a particular strength associated to a particular cost; it appears that to retain a suitable output, the wide loom has to fulfill the following requirements:

a. compulsory use of stronger warp threads which are consequently more costly;
b. limitation of the warp thread density (texture);
c. compulsory use due to the very high acceleration, of a stronger weft thread, thus more costly and the higher twist of which depreciates the fabric appearance.

This invention has for object to obtain an area output which is larger than the wide loom output without the above-mentioned drawbacks; the multiple loom according to the invention thus makes it possible to use the most usual grades of warp and weft threads in the most dense textures.

For this purpose according to the invention, the multiple loom has for characteristic that each loom is self-working, each loom has a lance guide approximately in the shape of a quarter circle extended vertically and there are provided lance-control mechanisms which are arranged on either side of a plane common to said guides.

In a particularly advantageous embodiment of the invention, the multiple loom comprises for each single loom, a weft-introducing lance which is slidable on a reed which is controlled by a crank-jointed mechanism which imparts to said reed a movement cycle that comprises in sequence a large-distance stroke corresponding to the weft-striking position, and a damped stroke occuring between two large-distance strokes.

In another advantageous embodiment of the invention when the warp threads run vertically, the mechanisms for controlling the reed movement and the movement of the weft-introducing lances are arranged in self-bearing frames located above the movement plane of the harness including the heddles for controlling the thread sheets and which are supported at the ends thereof.

In still another advantageous embodiment, the multiple loom according to the invention comprises a single driving motor for the multiple loom and each single loom has a drive unit with pulley and clutch, said pulley-clutch units being arrayed adjacent the multiple loom center axis.

Other details and features of the invention will stand out from the description given below by way of non limitative example and with reference to the accompanying drawings, in which.

Figure 1:
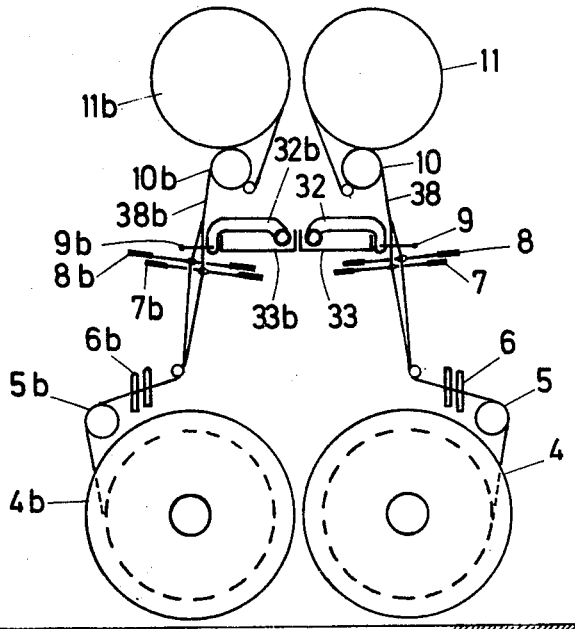
FIG. 1 is a side view of two back-to-back looms comprising a multiple loom with in the present case a total of four separate looms which are arranged side-by-side and back-to-back.

FIGS. 11, 12, 13 and 14 jointly show the various phases of the weft-introducing cycle.

In the various figures, the same reference numerals pertain to similar elements.

The unit will be first described with reference to FIG. 1.

Starting from the ground, there are first shown two warp-thread beams 4 and **4*b*. The warp threads pass round thread-bearing rollers 5, they go through the warp-protector leaves 6, then they are divided into two sheets controlled by the heddles 7, 8. Said sheets the run past the reed 9 and they form by crossing with a weft, the fabric 38. Said fabric 38 is pulled by a pulling cylinder 10 and it is collected by a roller 11. In this small-scale figure are only shown diagrammatically the two separate supporting frames 33, 33*b* inside which swing the swords bearing the reeds 9, 9*b***. This FIG. 1 defines the back-to-back arrangement of two unit looms.

Figure 2:
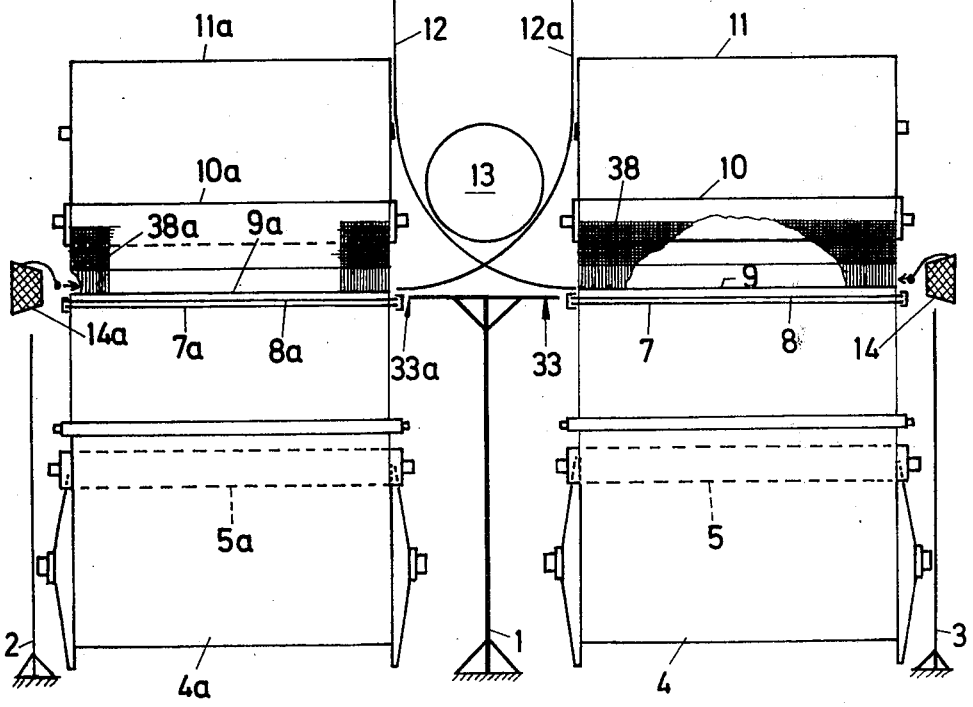
FIG. 2 is a front elevation view of two looms arranged side-by-side with an overlapping according to the invention.

FIG. 2 defines in turn the side-by-side overlapping of two unit looms. There is shown again in elevation, the vertical run of the warp threads from the beams 4, 4*a* to the fabric rollers 11, 11*a*. Along the figure axis are shown starting from the ground, the uprights 1, 2, 3 on which bear the frames 33*a*, 33. At the top are shown the guides 12, 12*a* of quarter circle shape with vertical extension for the weft-introducing lances and then is sketched (taking into account the drawing scale), the wheel 13 for driving the weft-introducing lances.

Figure 3:
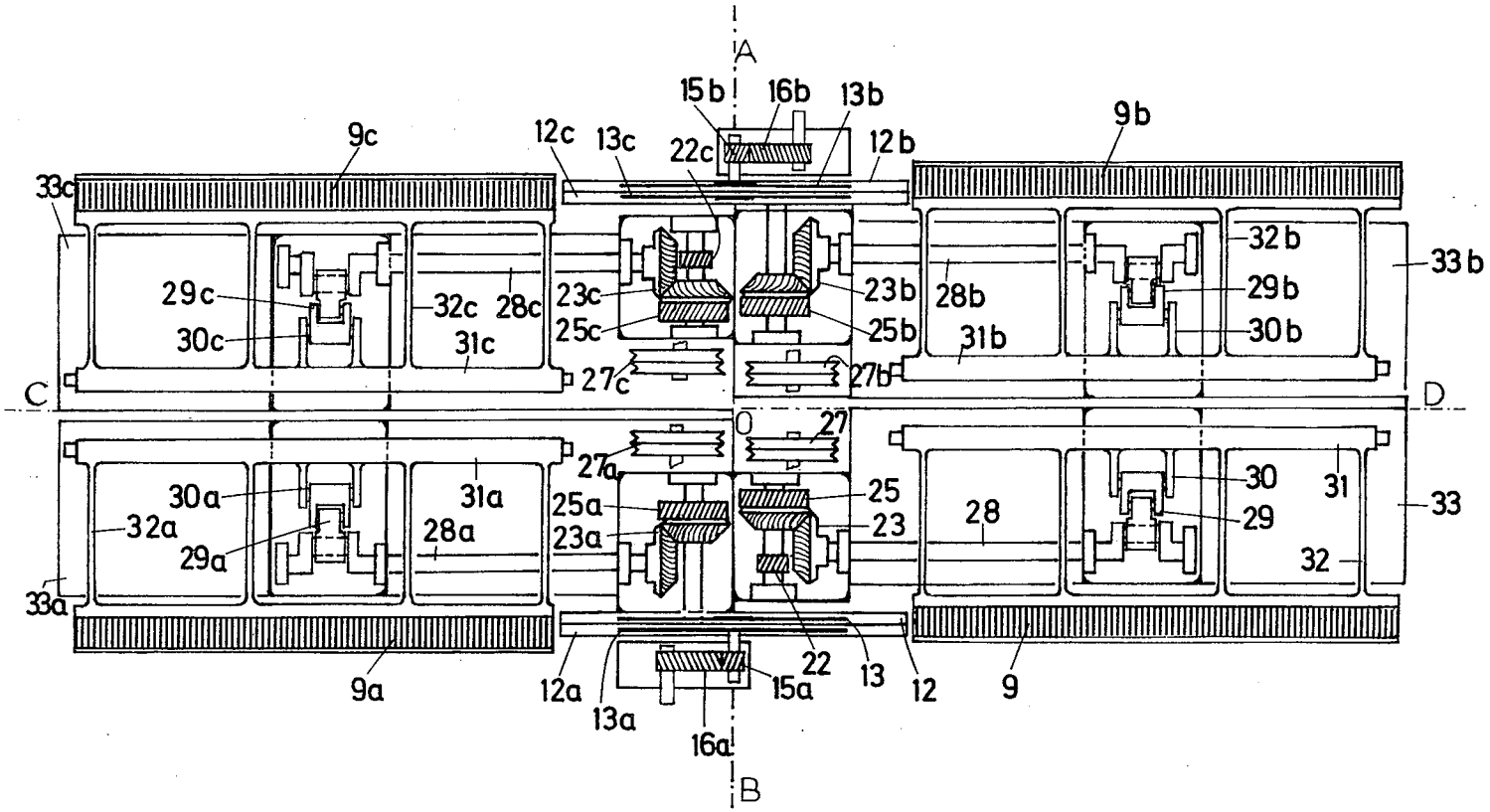
FIG. 3 is a plan view with parts broken away of a multiple loom according to the invention, with four looms arranged side-by-side and back-to-back.

FIG. 3 shows in a plan view the general arraying of four unit looms about two normal axes AOB, COD.

By considering the loom contained inside triangle BOD, it is noticed that the reed 9 is supported by four swords or webs 32 integral with the swinging shaft 31 driven by lever 30. Said lever 30 is operated in turn from crankshaft 28 through a jointed link 29. The driving of said link will not be further described as it is not part of the invention. At the end of crank-shaft 28 is shown a pinion 23 that forms a bevel gearing with a pinion 24 fast to the drive shaft which bears on the one hand a gear wheel 25 and on the other hand a small pinion 22. To make the drawings clearer, a small pinion 26 that forms together with the wheel 25 an integrated reducing gear has been shown but in FIG. 6. The four drive pulleys 27, 27*a*, *b*, *c* integral with the four pinions 26 have been shown. Between the reeds 9 and 9*a* are arranged the quarter-circle (U-shaped) guides 12, 12*a* for the weft-introducing lances and in the center of such guides gear wheels 13, 13*a* for driving the weft-introducing lances. In B and A on the general axis AOB are indicated pinions 15*a* and 15*b* integral with wheels 13*a* and 13*b*. For clearness sake, pinions 15 and 15*c* have not been shown here but they are shown in detail in FIGS. 4, 5 and 6.

Figure 4:
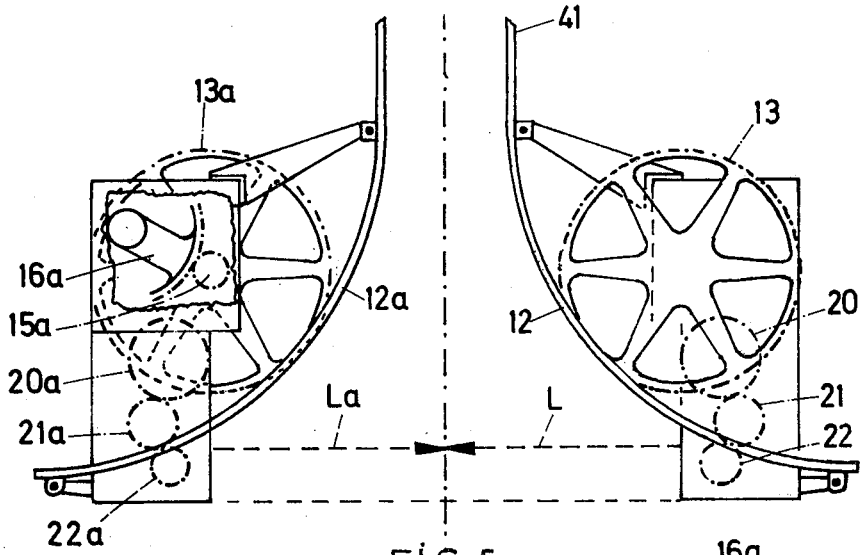
FIG. 4 is a spread-out elevation view on a larger scale, of the weft-introducing lance guides and control mechanisms, showing the overlapping thereof.
Figure 5:
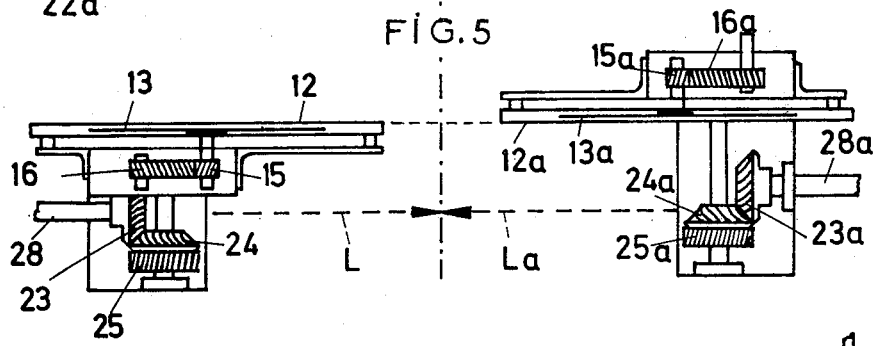
FIG. 5 is a plan view of the mechanisms shown in FIG. 4.

In FIG. 4 is seen a horizontal dotted line ending in two arrows meeting on the center axis. Said dotted lines show the path which is to be followed by both weft-introducing units for a complete overlapping. There is noticed the quarter-circle guides 12, 12*a*, the upwards extensions of which have been partly shown. On the left-hand side there is shown by means of broken-away parts, that gear wheel 13*a* is integral with a pinion 15*a* meshing with a toothed segment 16*a*.

In FIG. 5 are shown again the dotted lines with arrows that define the overlapping but it will be noticed that the step-up gear comprised of the segment 16 and pinion 15 lies inside the loom while the step-up gear 16*a*, 15*a* lies outside. When the arrow path is followed, it will be clear that both gear wheels 13*a* and 13 lie facing one another co-axially while still remaining separate.

Figure 6:
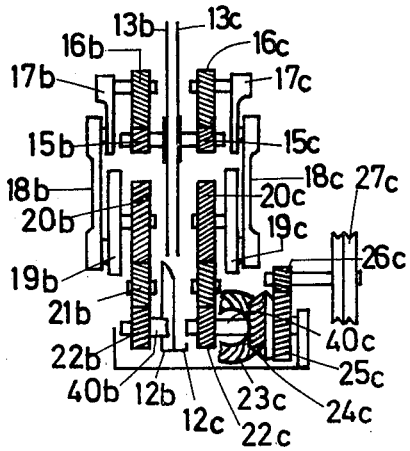
FIG. 6 is a side view with parts broken away of the kinematic chain for the weft-introducing lances for two looms arranged side-by-side with overlapping.

In FIG. 6, said wheels 13*b*, 13*c* are shown sidewise and it is possible to follow the whole kinematic chain of the movement thereof. The driving force supplied by pulley 27 to the reducing gear 26, 25 reaches through pinion 22 and intermediate wheel 21, the wheel 20 (with a ratio ½) which is integral with crank-disk 19. Said disk 19 imparts through link 18 a swinging movement to lever 17 which drives the step-up gear 16, 15. Pinion 15 drives with an angle-amplified swinging, the gear wheel 13. At the bottom of FIG. 6 will be noticed part of the quarter-circle guides 12, 12*a* as well as part of the bevel gearing 23, 24.

Figure 7:
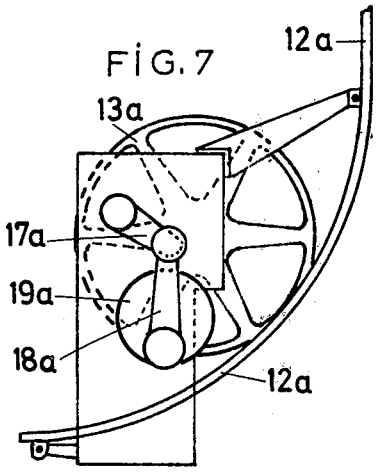
FIG. 7 is an elevation view of a detail of the control for a weft-introducing lance.

FIG. 7 shows in more detail the drive by means of disk 19*a* link 18 and lever 17 of said step-up gear.

Figure 8:
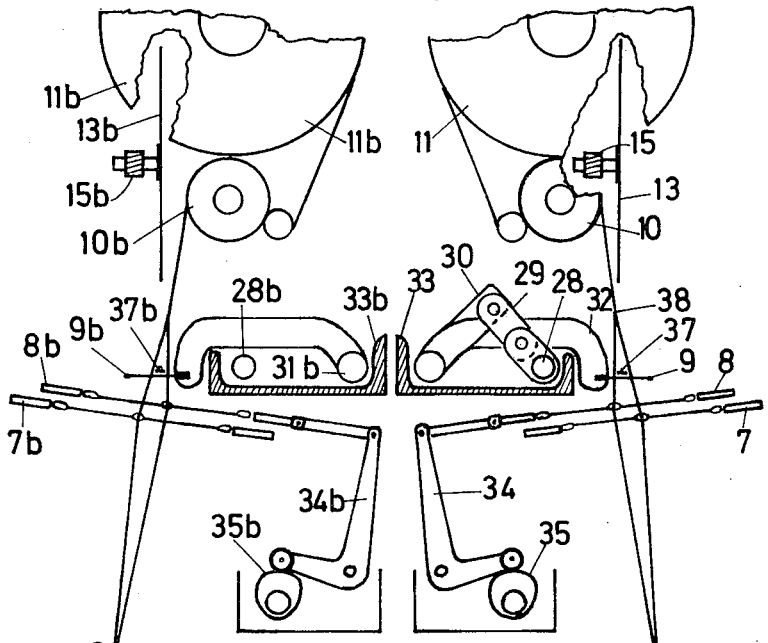
FIG. 8 is a side view on a larger scale of part of the two back-to-back looms of FIG. 1, showing in detail the reed and warp sheet mechanisms.

FIG. 8 is a detail view on a twice as large scale of the top of FIG. 1. By means of parts broken-away in fabric rollers 11, 11*b*, the position of the wheels 13 for the weft introducing has been shown and it is to be noticed that as mentioned above, pinions 15 and 15*b* lie one on the outside and the other on the inside of the throw planes of the weft-introducing lances. In the self-bearing frames 33, 33*b* are further shown the moving members for the reeds 9, 9*b* which are comprised of the crank-shaft 28, the jointed links 29, the levers 30, the swinging shafts 31 fast to the four swords 32. It is clear that the area below the supporting frames is completely devoid of any mechanical element relating to both movements of the reed and the weft-introducing lances. This leaves a complete freedom of movement to the heddles 7 and 8. It is shown that the heddle is operated by a cranked lever driven by a cam 35.

Figure 9B:
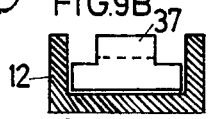
FIG. 9B is a section view along line IXB-IXB in FIG. 9A of the weft-introducing lance located inside the guide thereof.
Figure 9A:
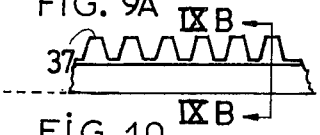
FIG. 9A is an elevation view on a larger scale, of part of the weft-introducing lance.

The FIGS. 9A and 9B show in detail on an actual-size scale, the weft-introducing lance 37. Said lance is a semi-rigid rack which is shown in section to the left inside the quarter-circle guide 12 of U-shape and then to the right in a side view. It is to be noticed that the curvature required of this rack forms a wheel with inner teeth that mesh with a plurality of teeth of gear wheel 13 which is very advantageous as regards the silence, the life and the working of the teeth.

Figure 10:
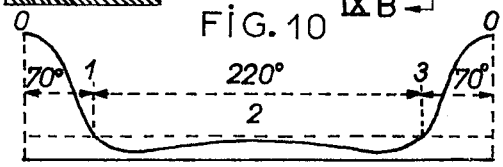
FIG. 10 is an angular diagram of the movement cycle of the reed movement in a loom which is part of the multiple loom according to the invention.
Figure 11:
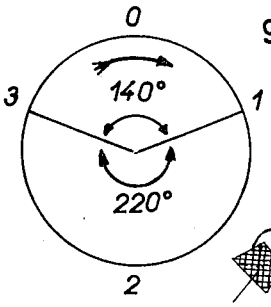
Figure 12:
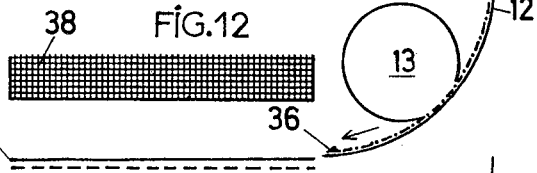
Figure 13:
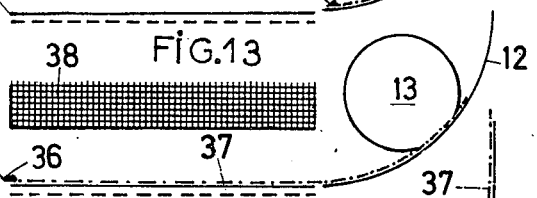
Figure 14:
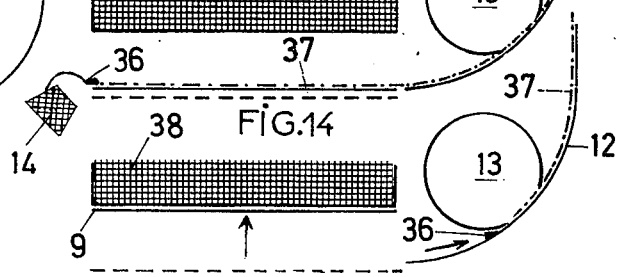

FIGS. 10, 11, 12, 13, 14 that comprise the total showing of the reed and lance cycles should be considered simultaneously. At both ends of FIG. 10 are shown two points 0 which correspond to both peaks of the curve shown which is the reed movement curve. Said points 0 give the end beating position of the weft which corresponds in FIG. 14 to the reed 9 abutting the fabric 38. This point 0 is visible in FIG. 11 which shows the cycle as circular development. By following the curve the position 1 is reached which corresponds to the lowering of reed 9 to the level shown in FIG. 12, that is slightly below the level of guide 12 for rack 37. Thus rack 37 bearing the weft clamp 36 will use the reeds as sliding surface to reach the opposite edge of fabric 38 in FIG. 13, that is the position 2 on the linear cycle and on the circular cycle in FIG. 11. Thereafter the clamp pulls the weft through phase 2–3 of the cycle and leaves the reed in 3. The reed 9 can then rise to beat the weft, phase 3–0 shown in FIG. 14. The clamp 36 is shown there fully retracted inside the guide 12 thereof. It is noticed at the bottom of FIGS. 12, 13, 14 the presence of one and the same dotted line which corresponds to the lowest level reached by reed 9 in two points which are to be seen on the curve in FIG. 10. This means that the semi-rigid rack 37 performs due to the flexible nature thereof, an alternating motion over 200° on a sliding surface which is slightly movable in the height. This reed movement is obtained with a known jointed-link mechansim which substantially compensates the reed beating for every other revolution (phase 2 in FIGS. 10 and 11). It is to be reminded that the reducing ratio of pinion 22 and gear wheel 20 integral with crank-disk 19 which causes the alternating motion of the weft-introducing lance is 1:2.

It must be understood that the invention is in no way limited to the above embodiments and that many changes can be brought therein without departing from the scope of the invention as defined in the appended claims.

I claim:

1. An improved loom system comprising:

at least a pair of vertical looms located side-by-side and having harness means for forming sheds between vertical wrap yarns, the sheds being disposed on either side of and adjacent a common plane;

reed combs associated with the shed of each loom, each comb including an upper, substantially horizontal planar surface area across its width;

a weft feeder for each loom, each weft feeder comprising a flexible lance with a weft clamp at its extremity;

arcuate guide means for each weft feeder lance for guiding its travel in an arcuate path from a generally vertical to a generally horizontal direction parallel to and contiguous with the upper surface of the reed comb of its respective loom;

means for cyclically driving each weft feeder along its arcuate guide and through its respective shed in the manner of a reciprocating stroke;

said weft feeder guide means being disposed on either side of and adjacent said common plane extending between the sheds;

whereby said weft feeder lances are driven through the respective loom sheds in opposite directions on either side of and adjacent said common plane.

2. The loom system of claim 1 wherein each reed comb moves cyclically vertically over relatively long strokes to beat the weft and moves over a relatively short stroke between the long strokes, each of said weft feeder lances moving over the upper surface of its respective reed comb while the latter is between its longer strokes.

3. The loom system of claim 1, including control linkage means for each comb, said control linkage means for the reed combs being located to one side of the vertical warp yarns and above the harness.

4. The loom system recited in claim 1, further including an additional pair of side-by-side looms similar to and located immediately behind said first recited pair of vertical looms, the linkage control means for the reed combs being disposed between the vertical warp yarns of opposite pairs of looms and above the harness of each loom.

5. The loom system of claim 4, further including a single drive motor for the four looms, each loom having a respective driving pulley and clutch driven by said drive motor, the driving pulleys and clutches being located centrally of the four looms.

* * * * *